United States Patent [19]

Akaba et al.

[11] Patent Number: 5,027,130

[45] Date of Patent: Jun. 25, 1991

[54] TAPERED ENERGY ABSORBING RADOME PORTION

[75] Inventors: Noriyuki Akaba; Satoshi Itoh, both of Tokyo, Japan

[73] Assignee: Tokyo Keiki Co., Ltd., Tokyo, Japan

[21] Appl. No.: 514,245

[22] Filed: Apr. 25, 1990

[30] Foreign Application Priority Data

May 15, 1989 [JP] Japan ..... 1-121182

[51] Int. Cl.[5] ..... H01Q 1/28; H01Q 1/42

[52] U.S. Cl. ..... 343/872; 343/784

[58] Field of Search ..... 343/872, 784, 705, 708

[56] References Cited

U.S. PATENT DOCUMENTS

| | | | |
|---|---|---|---|
| 3,766,562 | 10/1973 | Pollin | 343/872 |
| 4,086,591 | 4/1978 | Siwiak et al. | 343/872 |
| 4,520,364 | 5/1985 | Perry | 343/872 |
| 4,659,598 | 4/1987 | Traut | 343/872 |

*Primary Examiner*—Michael C. Wimer

*Assistant Examiner*—Hoang-anh Le

[57] ABSTRACT

A radome includes a radome member formed of a dielectric to protect an antenna element from outside space and a structural member formed of metal for supporting the antenna element at the center thereof and to which the radome member is joined at the periphery of the antenna element to support the radome member. When the radome member is formed of dielectric and the structural member is formed of metal, the junction therebetween serves as a kind of antenna and the radiation characteristic of the ordinary antenna element is disturbed. To solve this problem, a portion of the radome member through which an electric wave is transmitted is formed of material through which an electromagnetic wave having a frequency identical with that of the electric wave is transmitted and a junction formed between the radome member and the structural member has a structure for absorbing the electric wave.

16 Claims, 3 Drawing Sheets

TAPERED ENERGY ABSORBING RADOME PORTION

FIELD OF THE INVENTION AND RELATED ART STATEMENT

The present invention relates to a radome. The radome is a dust-proof and water-proof cover for an antenna.

FIG. 7 is a partially broken perspective view of a conventional radome.

An antenna element 1 is fixedly mounted to a post or the like through a structural member 2. The structural member 2 is commonly formed of metal and serves as a support member of a radome member 3 in this example. The radome member 3 is positioned intermediate the antenna element and the outside space and the electric wave is transmitted through the radome member 3. Accordingly, the radome member 3 is manufactured in consideration of electrical characteristics (such as, for example, transmissivity and reflectivity of the electric wave) and mechanical strength (such as, for example, a wind pressure tight characteristic).

In the example of FIG. 7, in order to approximate the transmissivity of electric wave in a portion 3*a* through which the electric wave from a radiation plane 4 of the antenna element of the radome member 3 is transmitted to 100%, the portion 3*a* is adapted to be formed of a sufficiently thin film structure or is formed of a multilayer structure made of materials having different dielectric constant and having a large transmissivity in a particular frequency range. On the other hand, a portion 3*b* which is joined to the structural member 2 of the radome member 3 is formed of hard material to settle the strength. Generally since the hard material has the high electric constant, metal forming the structural member 2 is covered by the dielectric having the high dielectric constant. That is, a transmission path having a small loss is formed. Further, an end surface of the radome member 3 is in contact with the metal portion.

In the conventional radome, a current induced in the structural member 2 by an excitation current of the antenna element 1 flows as shown by the broken line 5 of FIG. 7. An electromagnetic wave generated by the induced current is propagated in a junction 3*b* of the radome member and reflected by the contact surface with the metal portion. That is, there is a problem that the junction 3*b* serves as a kind of antenna and disturbs the radiation characteristic of the antenna element 1. This phenomenon can not be avoided as far as the radome member is formed of the dielectrics and the structural member is formed of metal.

When this phenomenon occurs, the frequency dependency of the radiation pattern of the electric wave from the antenna element becomes remarkable, particularly in the case of an applied apparatus of an amplitude comparison monopulse system, the accuracy of the system is deteriorated.

OBJECT AND SUMMARY OF THE INVENTION

It is an object of the present invention to provide a radome capable of suppressing the antenna effect in the junction of a radome member and a metal portion.

In order to solve the above problems, the radome including a radome member formed of a dielectrics to protect an antenna element from outside space and a structural member formed of metal for supporting the antenna element at the center and to which the radome member is joined at the periphery of the antenna element to support the radome member, is characterized by the provision of a portion of the radome member through which an electric wave is transmitted and which is formed of material through which an electromagnetic wave having a frequency identical with that of the electric wave is transmitted and a junction formed between the radome member and the structural member and having a structure for absorbing the electric wave.

In the prior art, the reduction rate $\alpha$ of the electromagnetic wave in the radome member by an induced current in the structural member is very small. Accordingly, the electromagnetic wave propagating the radome member is reflected by a contact surface of the radome member and is emitted to the outside space. Consequently, the radiation characteristic of the antenna is changed.

In the present invention, the junction of the radome member and the structural member includes the electric wave absorption structure containing electric wave absorption material and the electromagnetic wave propagating the portion is attenuated greatly. Consequently, the electromagnetic wave generated in the dielectrics of the radome member is controlled due to the induced current flowing through the structural member being radiated in the outside space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF PREFERRED EMBODIMENTS

Figure 1:
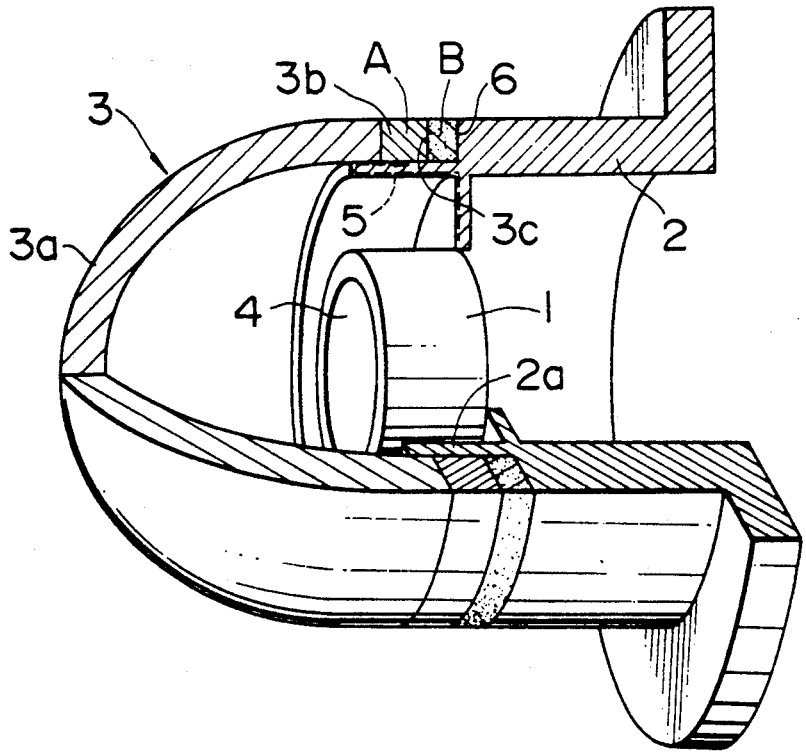
FIGS. 1 to 4 are partially broken perspective views of preferred embodiments of an antenna provided with a radome according to the present invention.

FIG. 1 is a partially broken perspective view of a preferred embodiment of an antenna having a radome according to the present invention.

An antenna element 1 which is a monopulse antenna is fixedly mounted to a support or the like by a structural member 2. A portion 3*a* of a radome member 3 through which an electric wave from a radiation plane 4 of the antenna is transmitted is formed of a dielectrics having a transmissivity for an electric wave of about 100%. On the other hand, a junction 3*b* formed between the radome member 3 and the structural member is formed of two portions A and B. The first portion A is formed of a dielectrics having a strength capable of supporting the radome member 3 sufficiently and the radome member 3 is joined to an outer surface of a cylindrical portion 2*a* of the structural member 2. An end surface 3*c* of the radome member 3 is not in direct contact with an annular shoulder 6 of the antenna support 2 and a second portion B of the junction 3*b* constituting an annular electric wave absorption member is disposed between the end surface 3*c* and the annular shoulder 6. An electromagnetic wave generated by an induced current 5 flowing through the structural member 2 is attenuated in the second portion B constituting the electric wave absorption member. Material containing carbon, carbonyl iron powder or the like can be used as the electric wave absorption member.

Figure 5:
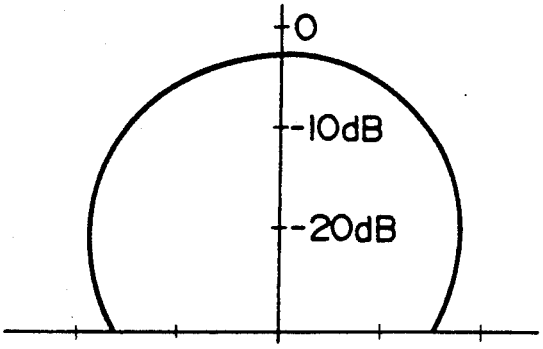
FIG. 5 shows an example of a directivity characteristic of an antenna having no radome.

FIG. 5 is a graph showing an example of a directivity characteristic of an antenna formed of only a monopulse antenna element and a structural member and having no radome.

Figure 6:
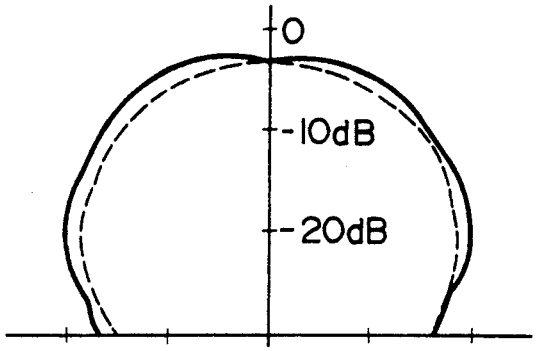
FIG. 6 shows an example of a directivity of an antenna having a radome.
Figure 7:
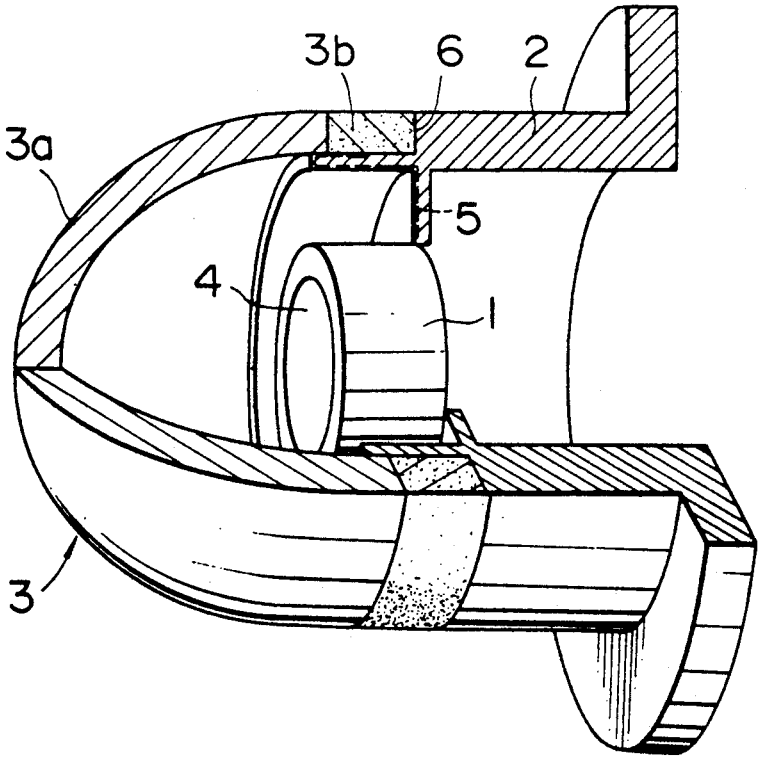
FIG. 7 PRIOR ART
FIG. 7 is a partially broken perspective view of an antenna having a conventional radome.

FIG. 6 is a graph showing a directivity characteristic of an antenna formed of a monopulse antenna element, a structural member and a radome. Solid line shows the case having the conventional radome of FIG. 7 and broken line shows the case having the radome according to FIG. 1 embodiment. It is apparent from the figure that the directivity of the conventional radome is disturbed while the directivity of the antenna having the radome according to the present invention approximates the directivity without radome.

Figure 2:
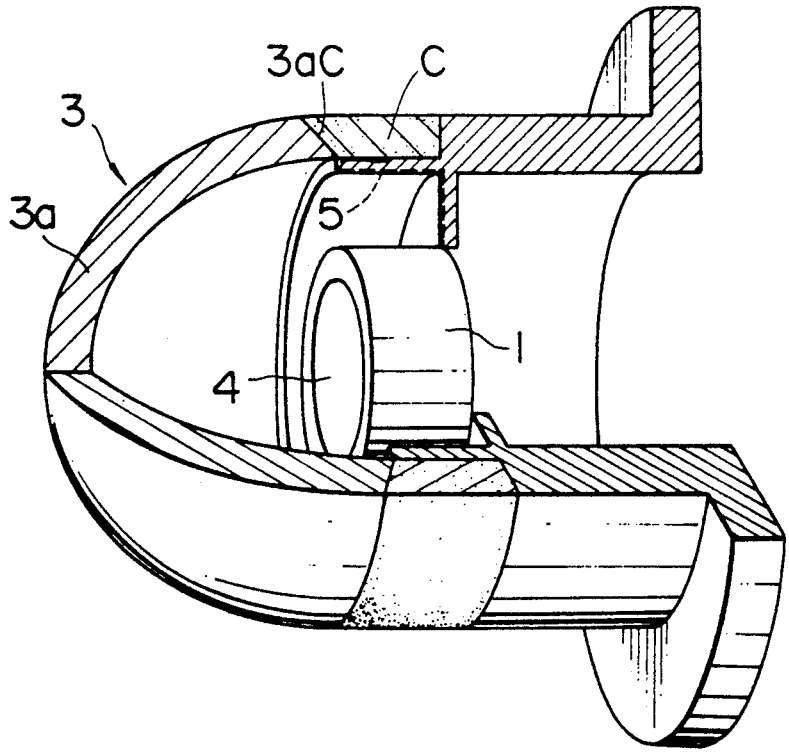

FIG. 2 is a partially broken perspective view of another preferred embodiment according to the present invention.

This embodiment is identical with the embodiment of FIG. 1 except only the structure of the junction between the radome member 3 and the structural member 2. The junction C between the radome member 3 and the structural member is formed of a dielectrics in which powder of the electric wave absorption member is mixed. Carbon, carbonyl iron powder or the like can be used as the electric wave absorption member. Mixing the electric wave absorption member into the dielectric (plastic) can be easily made using the common technique.

It is preferable that a boundary 3*a*C between the portion 3*a* through which the electric wave of the radome passes and the junction C is tapered as shown in FIG. 2. In this case, the function of the junction C as a termination element for the electromagnetic wave in the dielectric is great and the radiation of the electromagnetic wave from the radome member to the outside space is reduced.

Figure 3:
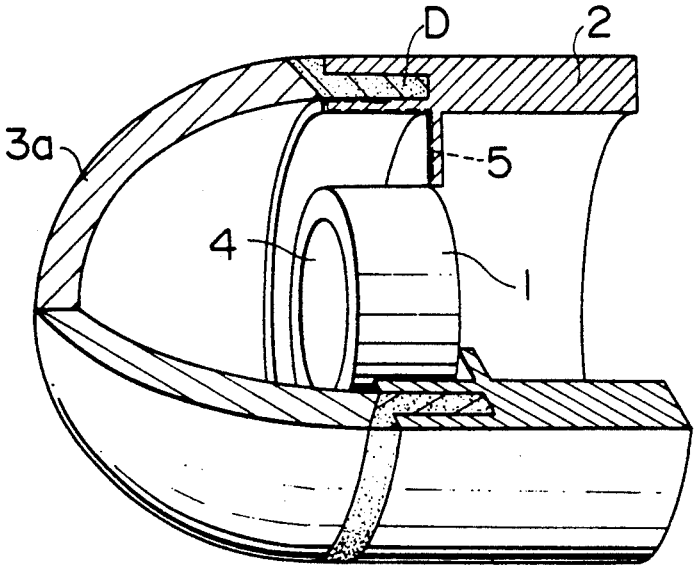

FIG. 3 is a partially broken perspective view of a still further embodiment of the present invention.

In this embodiment, only a shape of a boundary between the junction D of the radome member 3 and the structural member 2 is different from the embodiment of FIG. 2. Specifically, the junction D of the radome member 3 is embedded into a deep annular groove formed in the structural member 2. The junction D formed of the dielectric is reinforced by metal from the outside and accordingly the mechanical strength is large.

Figure 4:
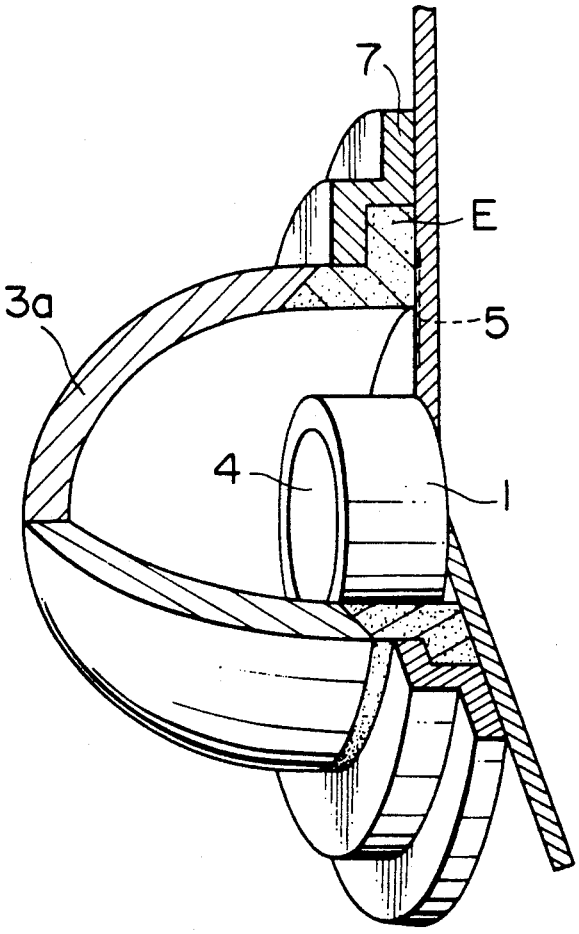

FIG. 4 is a partially broken perspective view of a still further embodiment of the present invention.

In this embodiment, only a shape of a boundary between the junction E of the radome member 3 and the structural member 2 is different from the embodiment of FIG. 2. An annular flange is provided in the radome junction E and is fixed to the structural member 2 by an annular mounting member 7 so that the radome member 3 is fixed to the structural member 2.

The effects of the present invention are as follows:

The junction includes the electric wave absorption structure and accordingly the attenuation factor of the electromagnetic wave in the transmission path is large. Thus, the junction is operated as the terminator. Consequently, an amplitude of the standing wave existing in the junction which is an element disturbing the antenna pattern is made small and the disturbance of the antenna pattern is also made small.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A radome comprising:

a metallic structural member;

an antenna element supported by the structural member at generally a center thereof, the antenna element generating an electromagnetic wave; and a dielectric radome member joined to the periphery of the antenna element and being attached to and supported by the structural member, the radome member enclosing the antenna element to protect the antenna element from the ambient environment, said radome member having first and second portions, the second portion being interposed between the first portion and the structural member, the second portion being formed from a material which will absorb the electromagnetic wave while the first portion is formed from a material which will permit transmission of the electromagnetic wave generated by the antenna element, a boundary between the first portion and second portion being tapered.

2. The radome as recited in claim 1, wherein the material of the second portion has the same material as the first portion with the addition of electric wave absorption powder mixed therein.

3. The radome as recited in claim 2, wherein the material of the first portion is a dielectric and the material of the second portion is a dielectric with one of carbon powder and carbonyl iron powder mixed therein.

4. The radome as recited in claim 3, wherein the dielectric material of at least the second portion is plastic.

5. The radome as recited in claim 1, wherein the first and second portion are an integral member and the material of the first portion is common to the material of the second portion.

6. The radome as recited in claim 1, wherein the second portion has a generally annular shape and the second portion encircles the antenna element.

7. The radome as recited in claim 6, wherein the first portion generally has an annular shape at least in the area of the boundary with the second portion, a generally horizontal cross section taken through the boundary forms an annular section having a uniform amount of the first portion and a uniform amount of the second portion.

8. The radome as recited in claim 1, wherein the second portion forms a continuous, uninterrupted band around the antenna element.

9. The radome as recited in claim 1, wherein the second portion is tapered such that the second portion becomes smaller and the first portion becomes larger in a direction away from the structural member.

10. The radome as recited in claim 9, wherein the tapering of the second portion forms a smaller section, the smaller section of the second portion being positioned on a side of the radome member away from the antenna element.

11. The radome as recited in claim 9, wherein the tapering of the second portion forms a smaller section, the smaller section of the second portion being positioned on a side of the radome member towards the antenna element.

12. The radome as recited in claim 1, wherein the second portion of the radome member has a junction embedded in a groove defined in the structural member, the junction thereby increasing mechanical strength of the radome member.

13. The radome as recited in claim 12, wherein the groove in the structural member is an annular groove which is generally filled with the junction.

14. The radome as recited in claim 1, wherein the second portion of the radome member generally has an L-shape in cross section.

15. The radome as recited in claim 14, further comprising a mounting member affixed to the structural member, the mounting member engages a section of the second portion to fix said radome member to the structural member.

16. The radome as recited in claim 1, wherein the second portion has a generally annular shape with a generally annular flange, the radome further comprising a mounting member engaging the annular flange, the mounting member being affixed to the structural member to fix said radome member to the structural member.

* * * * *